US005895150A

United States Patent [19]

Watabe et al.

[11] Patent Number: 5,895,150

[45] Date of Patent: Apr. 20, 1999

[54] ELASTIC BLADE FOR CONTROL OF DEVELOPER FEED, AND DEVELOPMENT DEVICE EMPLOYING THE SAME

[75] Inventors: Masahiro Watabe, Yokohama; Kentaro Niwano, Yamato; Arihiro Yamamoto, Tokyo, all of Japan

[73] Assignee: Canon Kabushiki Kaisha, Tokyo, Japan

[21] Appl. No.: 08/656,425

[22] Filed: May 30, 1996

[30] Foreign Application Priority Data

May 31, 1995 [JP] Japan ..... 7-155511

[51] Int. Cl.[6] ..... G03G 15/08

[52] U.S. Cl. ..... 399/284; 118/261

[58] Field of Search ..... 399/274, 284; 118/261; 430/120

[56] References Cited

U.S. PATENT DOCUMENTS 4,666,815 5/1987 Imai et al. ..... 430/126
5,353,104 10/1994 Kato et al. ..... 399/274
5,519,472 5/1996 Ojima et al. ..... 399/274
5,570,166 10/1996 Ohzeki et al. ..... 399/274 X

FOREIGN PATENT DOCUMENTS 6-258926 9/1994 Japan .
6-258934 9/1994 Japan .

*Primary Examiner*—William J. Royer
*Attorney, Agent, or Firm*—Fitzpatrick, Cella, Harper & Scinto

[57] ABSTRACT

An elastic blade is used in a developing device for controlling the amount of a developing agent (or a thickness of a developing agent fed onto a developing sleeve). The blade has on its surface an electrifying layer formed out of a specific polyamide elastomer. The polyamide elastomer is comprised preferably of a block copolymer of polyamide and polyester.

19 Claims, 6 Drawing Sheets

ELASTIC BLADE FOR CONTROL OF DEVELOPER FEED, AND DEVELOPMENT DEVICE EMPLOYING THE SAME

BACKGROUND OF THE INVENTION

1. Field of the Invention

The present invention relates to an elastic blade for controlling the amount of feed of a developing agent (hereinafter referred to as a "developer") for developing and visualizing an electrostatic latent image formed on an image-holding member, and also to a development device employing the elastic blade.

2. Related Background Art

Known development devices, as shown in FIG. 7, comprise a developer-bearing member 3 (hereinafter referred to occasionally as a "development sleeve") which is attached to a development vessel 2 at a small distance to an electrophotographic photosensitive member 1, an elastic blade 14 for controlling the amount of the feed of a developer, an elastic roller 5, and a one-component developer 6 (hereinafter referred to also as a "toner"). The elastic blade is brought into contact with the development sleeve to control the thickness of the toner layer delivered to the development section. A thin toner layer is formed on a development sleeve by allowing the toner to pass through the contacting portion between the elastic blade and the development sleeve, and simultaneously given electrification (triboelectricity) for developing latent images by the friction at the contacting portion.

Such an elastic blade includes ones constituted of a rubber plate, a metal thin plate, a thin plastic plate, or a laminate thereof.

For a positive type toner, the elastic blade is used which is formed by laminating an electric charge-imparting layer (hereinafter referred to as an "electrifying layer"), such as a charge-controlled silicone rubber, onto a thin plate, such as a metal plate, as a supporting layer.

For a negative type toner containing magnetite, a urethane rubber sheet is used which has been subjected to charge control treatment.

On the other hand, a low-temperature melting toner (sharp-melting toner) which is used in view of energy saving involves a problem that the toner tends to be fusion-bonded to the development blade to cause defective image formation. This problem can be solved by decreasing the contact pressure between the development blade and the development sleeve. At the lower contact pressure, however, the development blade should have a surface layer having higher triboelectrification ability at lower contact pressure. The conventional material such as urethane rubber used therefor was found to be insufficient in triboelectrification ability, disadvantageously.

The non-magnetic toner, which has come to be used for color image formation, is required to be more highly electrified and to be applied onto the development sleeve because of the non-magnetic properties of the toner itself. Since the urethane rubber as the surface layer of the development blade is not sufficient in triboelectrification ability as mentioned above, a polyamide having high electrification ability is used as the surface layer.

However, in the case where the polyamide is used as the surface layer material of the development blade, an ordinary non-magnetic toner is electrified excessively under low humidity conditions. The excessive electrification (charge-up) prevents the toner from being attracted from the development sleeve to the photosensitive drum, thereby resulting in defective image formation.

Further, for higher image quality and full color image formation by electrophotography, a finer particle size of the toner and uniform contact pressure onto the development sleeve are required. However, in conventional elastic blades, there is the limitation of uniformity of the press-contact with the development sleeve in its axis direction, and therefore, uniformity of the electric charge and thickness of the applied toner is insufficient, resulting in image defects such as image irregularity and streaks.

SUMMARY OF THE INVENTION

An object of the present invention is to provide an elastic blade for controlling the amount of feed of a developer which prevents excessive electrification of the developer and does not cause an image defect such as irregularity and streaks in the formed image.

Another object of the present invention is to provide a development device employing the elastic blade.

According to an aspect of the present invention, there is provided an elastic blade for controlling the amount of feed of a developer, the elastic blade which has on its surface an electrifying layer comprising a polyamide elastomer.

According to another aspect of the present invention, there is provided a development device which comprises a developer-holding vessel for holding a one-component type developer, a developer-holding member for delivering the developer from the vessel to a development portion, and a developer feed-controlling member for controlling the amount of feed of the developer to be applied onto the developer-holding member, wherein the developer feed-controlling member is an elastic blade having an electrifying layer comprising polyamide elastomer.

According to still another aspect of the present invention, there is provided an elastic blade for controlling the amount of feed of a developer which has a supporting layer for controlling a contact pressure, an elastic sponge layer, and an electrifying layer.

According to a further aspect of the present invention, there is provided a development device which comprises a developer-holding container for holding a one-component type developer, a developer-holding member for delivering the developer from the container to a developing portion, and a developer feed-controlling member for controlling the amount of feed of the developer to be applied onto the developer-holding member, wherein the developer feed-controlling member is an elastic blade which has a supporting layer for controlling the pressure, an elastic sponge layer, and an electrifying layer.

The elastic blade, which has an electrifying layer made of polyamide elastomer, can realize a high image density by preventing the developer from being excessively electrified owing to the characteristics of the polyamide elastomer of properly imparting frictional charge to the developer. The elastic blade is brought into uniform contact with the developer-bearing member due to the elastisity of the polyamide elastomer without positional variations in the contact pressure. Therefore, the developer can be carried in a uniform thickness with uniform electrification, thereby forming an excellent image free of image defects such as streaks or irregularity.

The elastic blade according to another embodiment of the present invention has an elastic sponge layer between the supporting layer and the electrifying layer, whereby the contact pressure between the developer supporting member and the electrifying layer of the elastic blade can be inhibited from varying in dependence on positions. Therefore, the developer can be carried in a uniform thickness with uniform electrification, thereby forming excellent images free of image defects like streaks or irregularity.

DETAILED DESCRIPTION OF THE PREFERRED EMBODIMENTS

Figure 1:
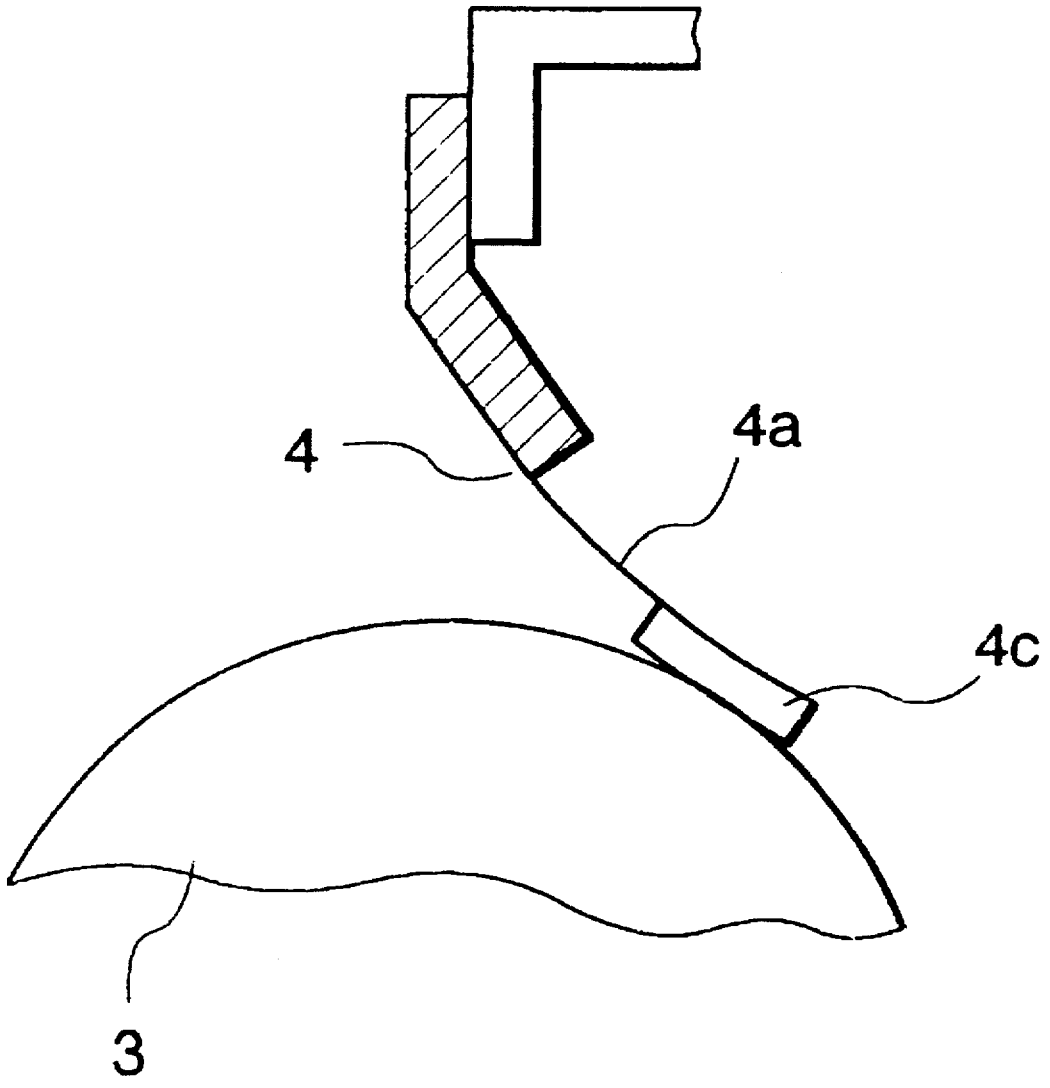
FIG. 1 illustrates a mode of using an elastic blade for developer feed control of the present invention.

FIG. 1 illustrates schematically a blade 4 for developer feed control, comprising a supporting layer 4*a*, and an electrifying layer 4*c*.

The electrifying layer 4*c* is formed of a polyamide elastomer at least at the surface. Preferred polyamide elastomers include block copolymers constituted of polyamide sequences and polyether sequences. The polyether-polyamide block copolymer exhibits frictional electrification properties due to the polyamide components, and exhibits elasticity due to the polyether components. Therefore, the elastic blade having the electrifying layer of the block copolymer is not required to have a coating layer and to contain an additive for improvement of triboelectrification properties, realizing production of the developer feed control blade at high productivity. Further, the blade having a supporting layer does not bring about permanent deformation of the blade which causes the contact pressure drop, so that occurrence of image defects can be inhibited.

The polyamide component of the polyamide-polyether block copolymer includes polyamides of 6, 6-6, 6-10, 6-12, 11, 12, and 12-12; polyamides derived by polycondensation between different types of polyamide monomers, preferably the ones of the terminal amino groups of which are carboxylated by dibasic acid. The dibasic acid includes saturated aliphatic dicarboxylic acids such as oxalic acid, succinic acid, adipic acid, suberic acid, sebacic acid and dodecanoic diacid; unsaturated aliphatic dicarboxylic acids such as maleic acid; aromatic dicarboxylic acids such as phthalic acid, and terephthalic acid; and polydicarboxylic acid synthesized from the above dibasic acid and a diol such as ethylene glycol, butanediol, hexanediol, octanediol, and decanediol.

The polyether component includes polyetherdiols produced by homopolymerization or copolymerization, such as polyethylene glycol, polypropylene glycol, and polytetramethylene glycol; and polyetherdiamines aminated at the both ends.

The polyether-polyamide block copolymer is formed from the polyether and the carboxylated polyamide by ester linkage formation (polyether-polyester polyamide) or amide linkage formation (polyether-polyamide).

For sufficient frictional electrification of the developer, the polyamide component preferably constitutes 20% by weight or more of the polyamide elastomer, whereas, for sufficient elasticity of the blade and prevention of excessive electrification of the developer, the polyamide component preferably constitutes 80% by weight or less of the polyamide elastomer.

The frictional electrification property of the electrifying layer of the elastic blade is evaluated as follows. The elastic blade and the development sleeve are set in the developing device. A toner, namely a developer, is delivered from the development device by rotation of the development sleeve, and is electrified by friction with the elastic blade. Thereby, the electrified toner is uniformly applied onto the development sleeve. The applied toner is collected by sucking. The amount of the electric charge (Q), and the weight (M) are measured. Therefrom, the electric charge of the toner per unit weight of the toner, Q/M (μC/g), is calculated. The amount Q/M of the electric charge of the toner is a suitable measure for the frictional electrification of the toner, since the measured value depends on the frictional electrification characteristic of the elastic blade.

The supporting layer preferably includes (1) a metal plate such as stainless steel plates (having tensile strength of about 110 $kg/mm^2$), phosphor bronze plates (having tensile strength of about 65 $kg/mm^2$), and aluminum plate (having tensile strength of about 40 $kg/mm^2$) in a thickness ranging preferably from 20 to 500 μm for satisfactory control of the contact pressure, and (2) resin plates such as polyethylene terephthalate resin plate (having tensile strength of about 20 $kg/mm^2$), polycarbonate resin plates (having tensile strength of about 10 $kg/mm^2$), and stretched polypropylene resin plates (having tensile strength of about 19 $kg/mm^2$) in a thickness ranging preferably from 50 to 1000 μm. Of the resin plates, preferred are biaxially oriented ones exhibiting less creep.

Another elastic blade of a second embodiment of the present invention comprises a supporting layer for controlling the contact pressure, a sponge layer as the elastic layer, and an electrifying layer for controlling the degree of electrification. The contact of the elastic blade with the development sleeve is made entirely uniform owing to the lower elasticity of the sponge layer. The effect is more remarkable when the electrifying layer is made from a rigid material such as a resin.

Figure 3:
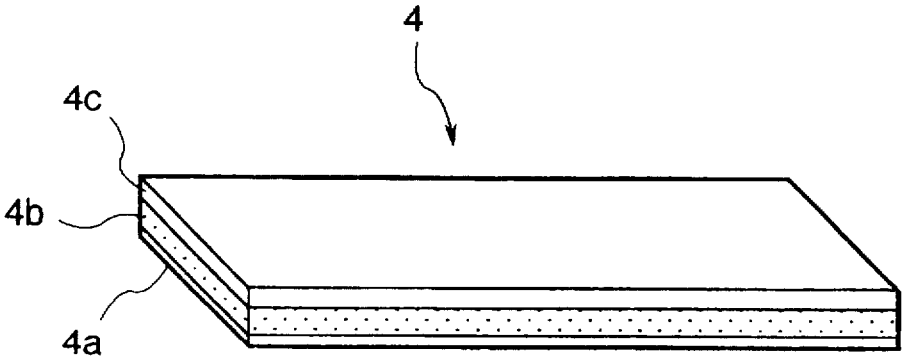
FIG. 3 illustrates the constitution of an elastic blade for developer feed control of the present invention.

FIG. 3 illustrates the constitution of an elastic blade 4 for developer feed control of the present invention, comprising a supporting layer 4*a*, an elastic sponge layer 4*b*, and an electrifying layer 4*c*. The supporting layer is made from the aforementioned material.

The sponge of the elastic layer may be either a rubber or a resin in a foam state produced by blowing with a blowing agent, preferably having a uniform foam density, a JIS-A hardness of not higher than 50°, and an elastic layer thickness of from 0.1 to 3 mm.

The blowing agent may be either a physical blowing type or a decomposition type. The physical blowing agent is a volatile compound which is liquid at an ordinary temperature and has a boiling point of not higher than 110° C., including aliphatic hydrocarbons such as propane, pentane, and hexane; aliphatic chlorinated hydrocarbons such as methylene chloride, and trichloroethylene; and aliphatic fluorinated hydrocarbons such as trichlorfluoromethane, and dichlorotetrafluoroethane. The physical blowing agent also includes inert gases such as air, and nitrogen. The decomposition type blowing agent includes inorganic blowing agents and organic blowing agents. The inorganic blowing agents include sodium bicarbonate, ammonium carbonate, magnesium carbonate, and ammonium nitrite. The organic blowing agents include azo type blowing agents such as azodicarbonamide, azobisformamide, azobisisobutyronitrile, and diazoaminobenzene; nitroso type blowing agents such as N,N'-dinitrosopentamethylenetetramine, and N,N'-dimethyl-N,N'-dinitrosoterephthalamide; hydrazine type blowing agents such as benzenesulfonyl hydrazide, toluenesulfonyl hydrazide, and p,p'-oxybis(benzenesulfonyl hydrazide); azide type blowing agent such as p-toluenesulfonyl semicarbazide; and hydrazone type blowing agents such as acetone-p-sulfonyl hydrazone.

The blowing agent may be used solely or in a mixture of two or more kinds, and, if necessary, a suitable blowing aid is mixed thereto. The blowing agent is added to the rubber or the resin in an appropriate amount. The blowing is conducted by hot molding and blowing to produce a sponge of a desired hardness.

The urethane rubber may be blown into a sponge by action of water in place of the above physical blowing agent or the decomposition type blowing agent. The silicone rubber may be blown into a sponge by decomposition gas of silanol reaction. The formed sponge is cut or ground into a piece of a desired shape, and the piece of the sponge is fixed by bonding.

For positive type toners, the electrifying layer is made preferably of a silicone rubber or a silicone resin; for negative type magnetic toners, preferably a urethane rubber or a urethane resin; and for negative type non-magnetic rubbers, preferably a polyamide elastomer or a polyamide resin. Such an electrifying layer is applied by coating or is bonded onto the sponge layer. The electrifying layer has a thickness of preferably not less than 2 μm.

In the elastic blade thus formed, an ASKER(C) hardness of the sponge layer and the electrifying layer which are combined together is preferably not higher than 50°. The elastic blade having layers of a higher hardness comes into line contact with the development sleeve to cause variation of the contact pressure in a sleeve axis direction owing to assembling error of the developing machine, so that defective images having streaks are liable to occur.

Figure 4:
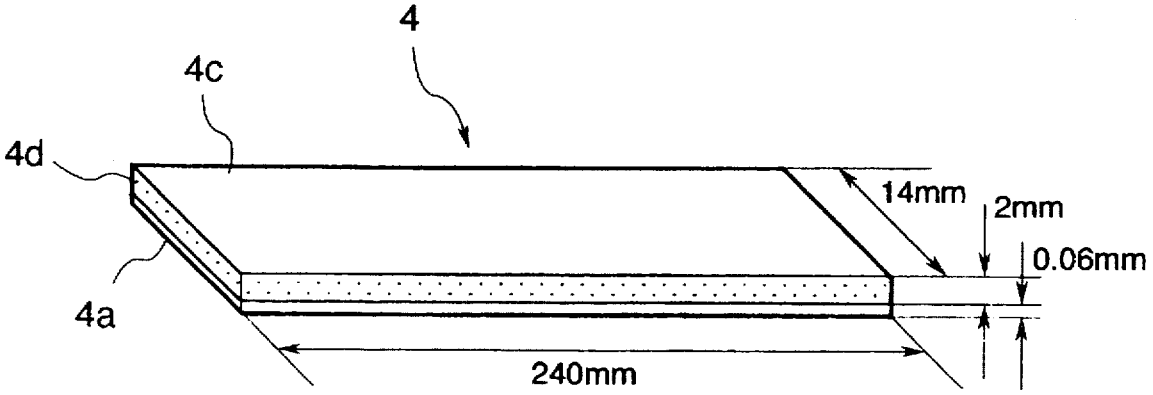
FIG. 4 illustrates constitution of another elastic blade for developer feed control of the present invention.

When the sponge layer and the electrifying layer are formed simultaneously, the electrifying layer is good in its surface roughness and the elastic blade can be brought into more uniform contact with the sleeve. For the formation, the rubber material or the resin material is mixed with a blowing agent and blown in a mirror-polished metal mold, and the skin layer is formed on the sponge surface by contact with the mirror-polished mold face. Thus an elastic blade having an electrifying layer with high surface precision could be produced by use of the skin layer as the electrifying layer. FIG. 4 illustrates schematically an elastic blade 4 in which an elastic layer 4*d* has as the electrifying layer a skin layer formed by the simultaneous formation.

As the blowing agent, preferred are decomposition type organic blowing agents because of their sharp decomposition temperature, and the capability of accelerating the decomposition at a lower temperature by the addition of a decomposition aid. The urethane rubbers and the urethane resins are blown in a metal mold by addition of water or a physical blowing agent to form simultaneously the sponge layer and the electrifying layer. The silicone rubber is blown in a metal mold with decomposition gas resulting from silanol reaction of the silicone rubber. Of the elastic blades thus prepared, the ones that have the sponge layer and electrifying layer combined together having an ASKER(C) hardness of not higher than 50°, are preferred.

Formation of a polyamide elastomer on an elastic sponge layer is also one of the preferred embodiments.

Next, a development device employing an elastic blade of the present invention will be explained.

Figure 2:
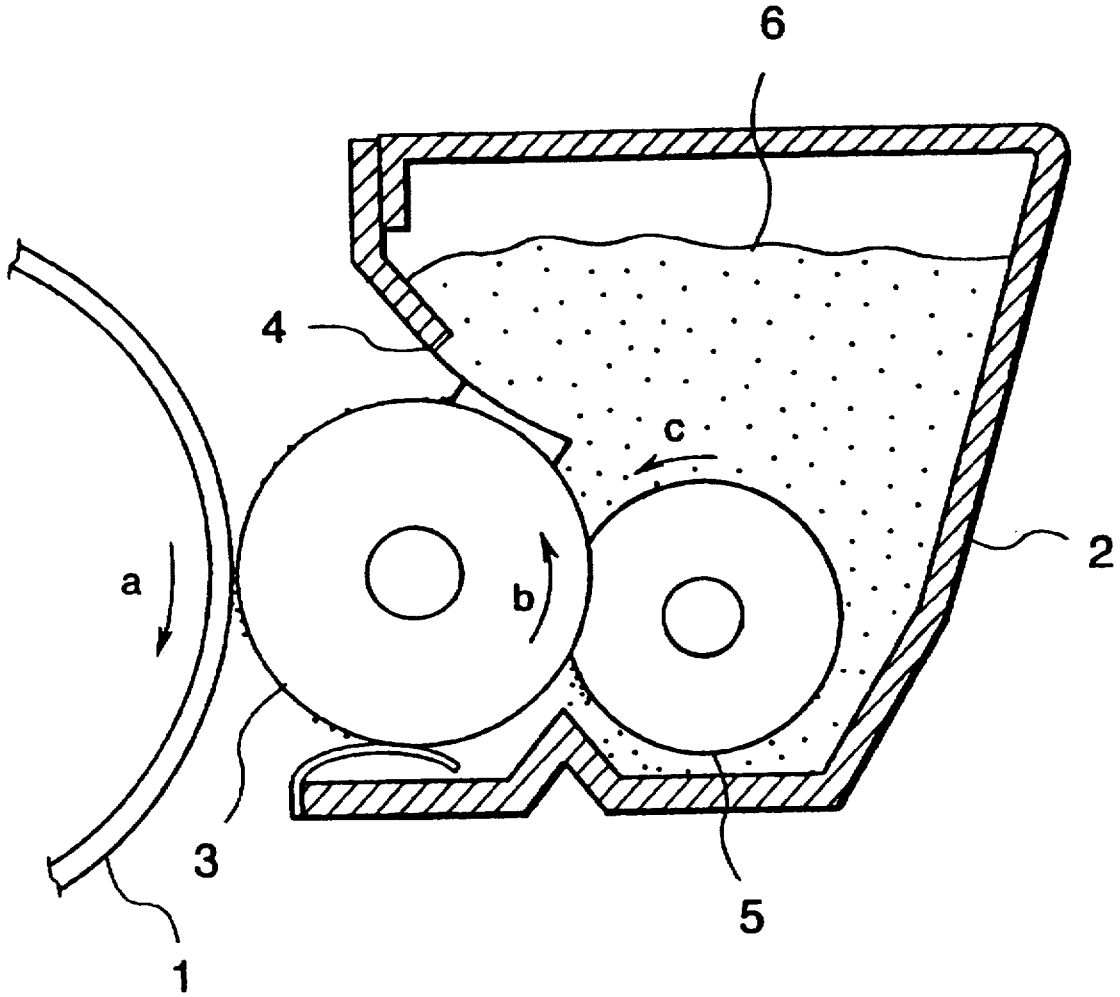
FIG. 2 illustrates a development device of the present invention.

FIG. 2 shows a constitution of an image-forming apparatus. A toner 6 is stored in a development vessel 2. The development device is provided with a development sleeve 3 facing a photosensitive member 1 which rotates in the direction shown by the arrow mark a to visualize an electrostatic latent image on the photosensitive member 1 as a toner image. As shown in FIG. 2, the right-side half periphery of the development sleeve 3 is put into the development vessel 2 and the left-side half periphery is exposed outside to face the photosensitive member 1. The sleeve 3 is horizontally set to rotate freely. A small gap is provided between the development sleeve 3 and the photosensitive member 1. The development sleeve 3 is driven to rotate in the direction shown by the arrow mark b relative to the rotation direction a of the photosensitive member 1 in the drawing.

In the development vessel 2, an elastic blade 4 of the present invention is provided at the upper side of the development sleeve 3, and an elastic roller 5 is provided to be in contact with the periphery of the development sleeve 3 before the contact line with the elastic blade 4 along the rotation direction of the development sleeve 3.

The elastic blade 4 is set to be slanted downward in the upstream direction of rotation of the development sleeve 3, and brought into contact with the upper periphery of the development sleeve 3 in opposition to its rotation direction.

The elastic roller 5 is brought into contact with the development sleeve 3 at the side of the development sleeve reverse to the photosensitive member 1, and is supported rotatably.

In the development device having the constitution as above, the elastic roller 5 rotates in the direction indicated by the arrow mark c to feed the toner 6 to the vicinity of the development sleeve 3. At the contact portion of the development sleeve 3 with the elastic roller 5 (nip portion), the toner 6 on the elastic roller 5 is transferred and adheres to the development sleeve 3 by friction with the development sleeve 3.

Thereafter, with the rotation of the development sleeve 3, the toner 6 adhering onto the development sleeve 3 is carried to the contact portion between the elastic blade 4 and the development sleeve 3. On passing through the contact portion, the toner is rubbed by the surface of the development sleeve 3 and the elastic blade 4 to be frictionally electrified sufficiently.

The toner 6 electrified as above is passed through the contact portion between the elastic blade 4 and the development sleeve 3 to form a thin layer of the toner 6 on the development sleeve 3, and is delivered to the developing portion of the development sleeve 3 facing the photosensitive member 1 at a small gap. By application of an alternate voltage formed by superposing a DC voltage onto an AC voltage, the toner 6 on the development sleeve 3 is transferred onto the photosensitive member 1 correspondingly to the latent image to visualize the latent image as a toner image.

The toner 6 remaining unconsumed on the development sleeve 3 in the developing portion is conveyed by rotation of the development sleeve 3 into the development vessel 2.

The toner 6 entering the development vessel is stripped off by the elastic roller 5 brought into contact with the development sleeve 3. Simultaneously, with the rotation of the elastic roller 5, a replenishing toner is supplied onto the development sleeve 3. The replenished toner 6 is again delivered to the contacting point between the development sleeve 3 and the elastic blade 4.

Most of the toner 6 stripped off from the development sleeve 3 is conveyed and mixed with the toner 6 in the development vessel 2 with the rotation of the elastic roller 5, thereby the electric charges of the stripped toner 6 being dispersed.

The useful toner includes known magnetic toners and non-magnetic color toners, and has preferably an average particle diameter in the range of from 3 to 15 μm.

Figure 5:
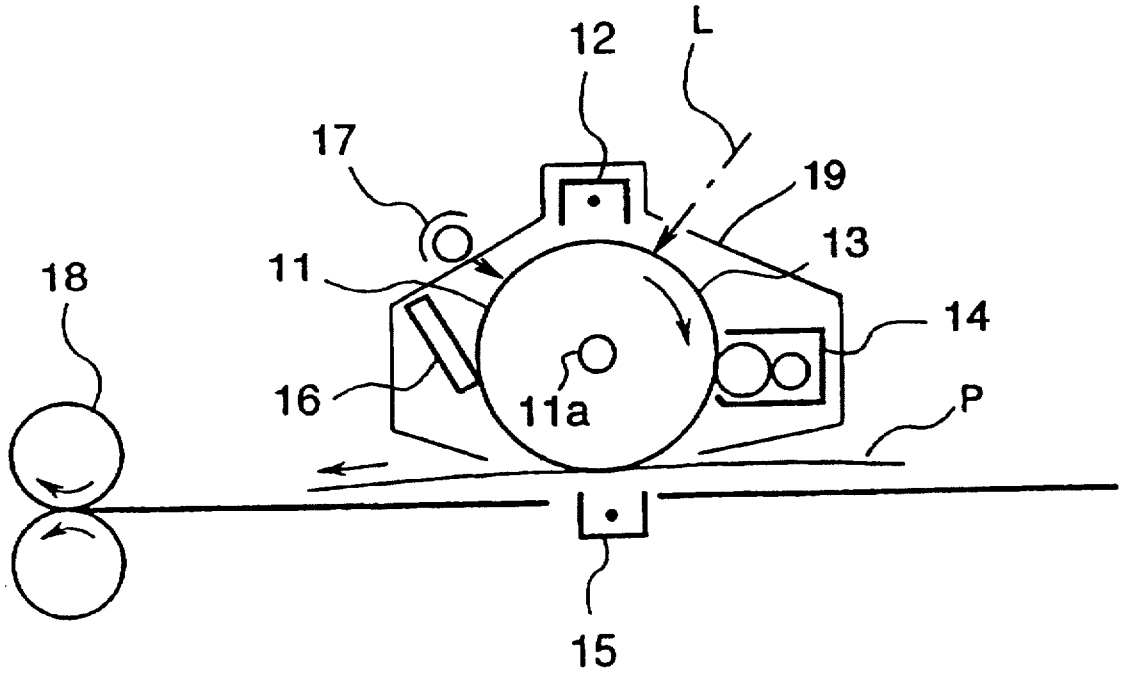
FIG. 5 illustrates the constitution of an electrophotographic apparatus employing the development device of the present invention.

FIG. 5 illustrates construction of an electrophotographic apparatus employing the development device of the present invention.

As shown in FIG. 5, the photosensitive member 11 is a drum type of electrophotographic photosensitive member to be electrified, which comprises an electroconductive supporting drum made of aluminum or the like and a photosensitive layer formed on the peripheral surface thereof as basic constitutional layers. The photosensitive member rotates around a supporting axis 11*a* at a prescribed peripheral speed clockwise as shown in the drawing.

An electrifying member 12, a corona discharger, is provided opposite to the surface of the photosensitive member 11 and electrifies primarily the photosensitive member surface at a prescribed polarity and a prescribed potential uniformly.

The surface of the photosensitive member 11 electrified uniformly by the electrifying member 12 is then exposed to a desired image information light (laser beam light scanning, slit exposure to an original image, and so forth) given by the light exposure means L, so that an electrostatic latent image 13 corresponding to the desired image information is formed on the peripheral surface. The latent image is successively visualized as a toner image by a development device 14.

The toner image is transferred onto a transfer-receiving material P delivered synchronously with the rotation of the photosensitive member 11 from a paper feeding means (not shown in the drawing) to a toner transfer portion between the photosensitive member 11 and a toner image transfer means 15. In this example, the transfer means 15 is a corona electrifier, and the toner image is transferred onto a transfer-receiving material P by electrification to a polarity opposite to the toner from the reverse face of the transfer-receiving material.

The transfer-receiving medium P having the toner image is separated from the surface of the photosensitive member 11 and is sent to a hot fixing roll 18 to have the toner image fixed thereon, and is discharged as an image copy.

The surface of the photosensitive member 11 after the toner image transfer is cleaned by a cleaning means 16 to remove remaining toner and other adhering matter subjected to erasure of a residual charge by a preexposing lamp 17, and repeatedly employed for image formation.

Two or more of the aforementioned constituting elements, such as the photosensitive member, the electrifying means, the developing device and the cleaning means, may be integrated into a process cartridge 19, so that the process cartridge can be made detachable from the main body of the apparatus. For example, a photosensitive member, a development device, and optionally an electrifying means and a cleaning means are integrated into a process cartridge so as to be detachable from the main body of an electrophotographic apparatus by the use of a guide means like a rail.

The development device of the present invention is useful for electrophotographic apparatuses such as copying machines, laser beam printers, LED printers, and electrophotographic engraving systems.

EXAMPLE 1

A polyamide elastomer was synthesized from 12-nylon as the polyamide component, and polytetramethylene glycol reacted with dodecanoic diacid, a dibasic acid, as the polyether component to obtain a polymer containing the polyamide at a content of 10% by weight. The above polyamide elastomer was dried at 70° C. from 6 hours.

The supporting layer is made from a phosphor bronze plate having a plate thickness of 0.12 mm, a width of 22 mm, and a length of 210 mm on the side where an electrifying layer is applied. This supporting layer is placed preliminarily in a metal mold.

The above elastomer was injected into the mold having the supporting layer therein at a melting temperature of 200° C. and the metal mold temperature of 30° C. to obtain an elastic blade having an electrifying layer of 1 mm thick, 5 mm wide, and 210 mm long.

EXAMPLE 2

An elastic blade was prepared in the same manner as in Example 1 except that the polyamide elastomer for the electrifying layer contained the polyamide at a content of 30% by weight.

EXAMPLE 3

An elastic blade was prepared in the same manner as in Example 1 except that the polyamide elastomer for the electrifying layer contained the polyamide at a content of 50% by weight, and was dried at 80° C. for 4 hours; and the electrifying layer was injection-molded at a melting temperature of 200° C.

EXAMPLE 4

An elastic blade was prepared in the same manner as in Example 1 except that the polyamide elastomer for the electrifying layer contained the polyamide at a content of 70% by weight, and was dried at 80° C. for 4 hours; and the electrifying layer was injection-molded at a melting temperature of 240° C.

EXAMPLE 5

An elastic blade was prepared in the same manner as in Example 4 except that the polyamide elastomer for the electrifying layer contained the polyamide at a content of 90% by weight.

COMPARATIVE EXAMPLE 1

An electrifying layer was formed from an ethylene adipate type polyester urethane rubber of a hardness 65° (JIS-A) into a sheet of 1 mm thick, and was bonded to a supporting layer and cut to obtain an elastic blade.

COMPARATIVE EXAMPLE 2

An elastic blade was prepared in the same manner as in Comparative Example 1 except that the formed urethane rubber as the electrifying layer was dip-coated with an alcohol-soluble nylon.(Amylan (M-8000) produced by Toray Industries, Inc.)

The prepared elastic blade, and a development sleeve made of an aluminum tube blast-treated to have 10-point average roughness of Rz=2.5 μm were set in a development device so that the elastic blade and the development sleeve are brought into contact with each other at a contact pressure of 18 g/cm. In the development vessel, a sponge roller made of a foamed polyurethane was installed which serves to apply the toner onto the development sleeve and to strip the remaining toner after the development from the development sleeve. The development vessel in which a non-magnetic toner is placed was mounted onto a laser beam printer (Laser Shot, manufactured by Canon K.K.). The development sleeve was driven at a lower temperature and a lower humidity of 15° C. and 10% RH. A state of toner coating and occurrence of streaks and irregularity in the toner layer were examined visually, and the electric charge (triboelectrification) of the toner was measured. Further, a solid black image was formed with a non-magnetic black toner on a paper sheet, and the image density was measured by means of a McBeth Densitometer. Table 1 shows the results of the evaluation of the blade material.

As shown in Table 1, the elastic blade of Comparative Example 1 did not exhibit a sufficient frictional electrification, giving low tribo-electrification. Therefore, streaks and irregularity were caused in toner coating on the development sleeve, and the development vessel was soiled by toner scattering, resulting in low density of the solid black image. On the other hand, the elastic blade of Examples 1–5 showed sufficient frictional electrification to give high tribo-electrification values and sufficient density of the solid black image. In Example 1, however, the triboelectrification is lower than that in Examples 2–4, and streaks and irregularity were found in the toner coating on the development sleeve, and the formed solid black image had a slightly lower density. In Example 5, slight streaks and irregularity were observed in the toner coating on the development sleeve, because of excessive electrification of the toner at low temperature and low humidity as understood from the tribo-electrification value, and the density of the solid black image was slightly lower. In Comparative Example 2, the adverse effect of the excessive electrification was observed, and the density of the solid black image was lower.

EXAMPLE 6

A stainless steel plate of 60 μm thick was placed in a preliminarily heated metal mold having a mirror-finished inside wall and provided with a vent mechanism. A urethane foam material was prepared by mixing and stirring the constituting materials of a polyester polyol, glycol, a polyhydric alcohol, and diphenylmethane diisocyanate; blowing agents of water and methylene chloride; a mixed catalyst of organotin compounds, and a foam stabilizer. The mixture was introduced into the metal mold. A polyurethane foam was prepared which had a skin layer having a surface on which the mirror surface was transferred. The resulting polyurethane foam was heat-treated to obtain a polyurethane foam material having an ASKER(C) hardness of 27°.

Figure 6:
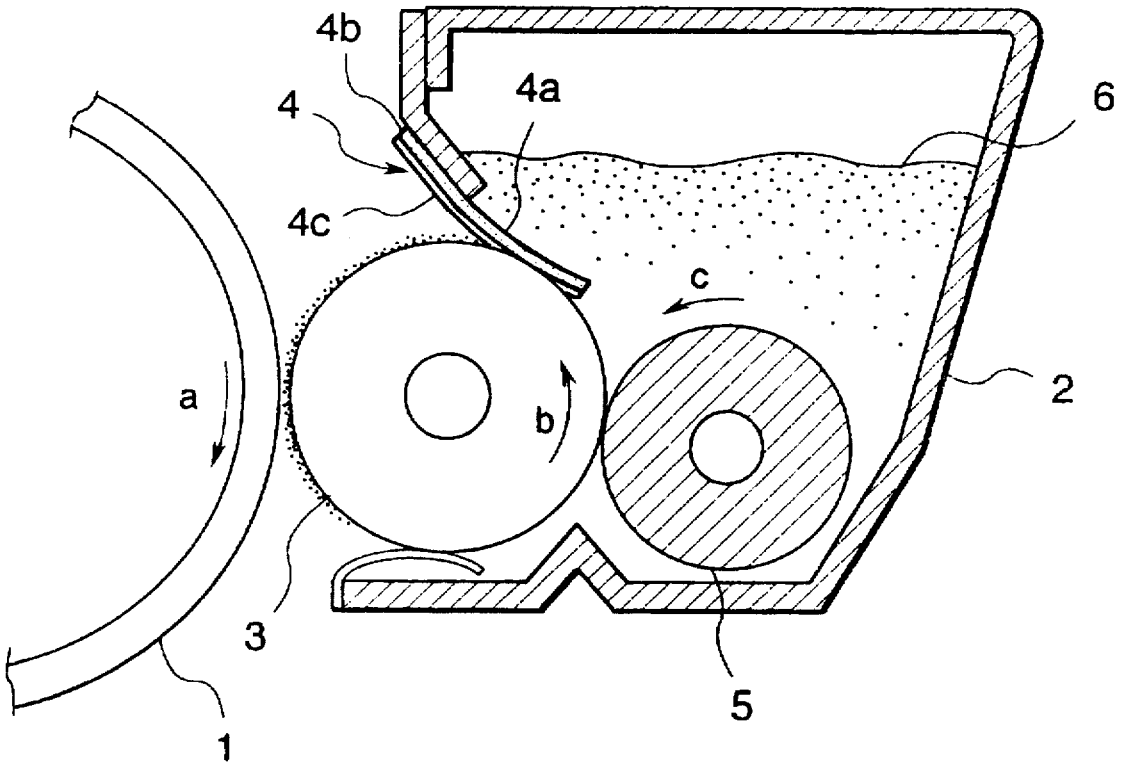
FIG. 6 illustrates a development device of the present invention.
Figure 7:
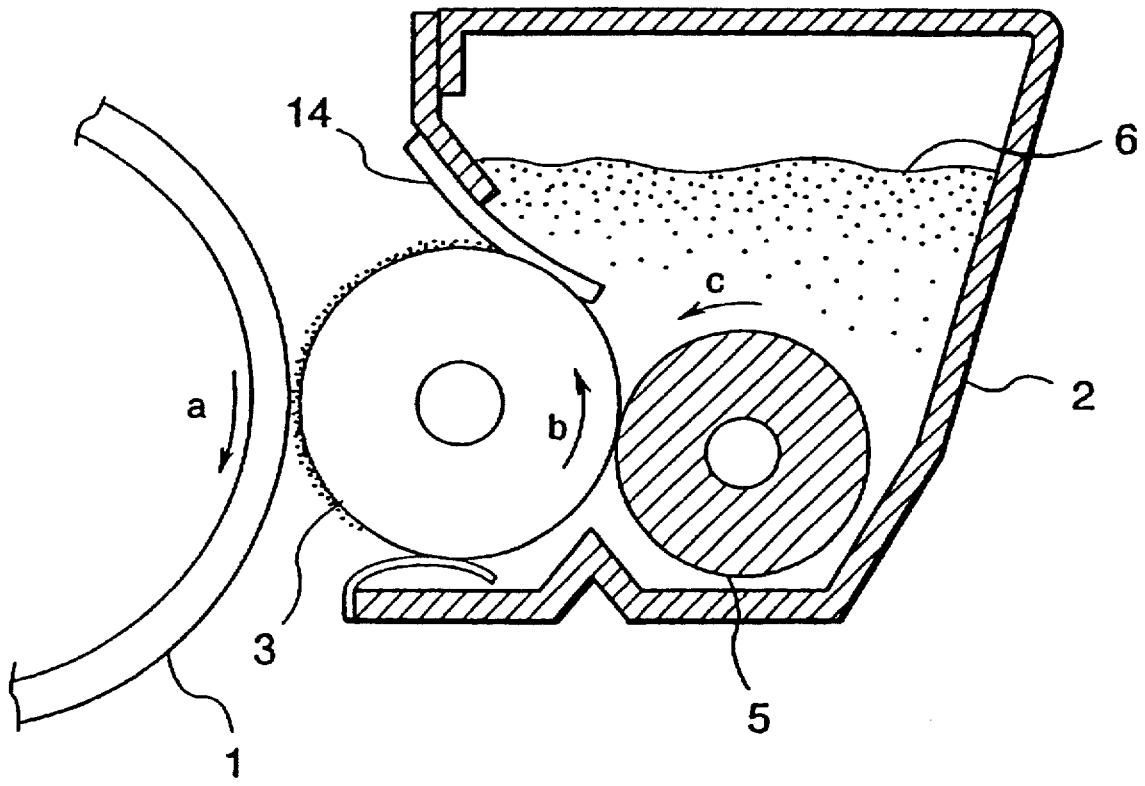
FIG.7 PRIOR ART
FIG. 7 illustrates the constitution of a development device employing a conventional elastic blade for developer feed control.

Thereafter, the polyurethane foam was secondarily processed to an elastic blade as shown in FIG. 4. The elastic blade was set in a development device, in which a non-magnetic color toner (an average particle diameter of 8 μm) was put and which was mounted on a laser beam printer (Laser Shot, manufactured by Canon K.K.) as shown in FIG. 6 (the reference number being the same as in FIG. 2). The solid color image formed on a paper sheet was evaluated for the streaks and irregularity. The grade "Good" means that the streaks and the irregularity were not observed and the image quality was satisfactory. The grade "Fair" means that slight streaks and irregularity were observed. The grade "Poor" means that the streaks and irregularity were remarkable.

EXAMPLE 7

An elastic blade having polyurethane foam of ASKER(C) hardness of 50° was prepared and evaluated in the same manner as in Example 6.

EXAMPLE 8

A stainless steel plate of 60 μm thick was placed in a preliminarily heated metal mold having a mirror-finished inside wall and provided with a vent mechanism. A mixture of a polyamide elastomer (Pebacks, produced by Toray Industries, Inc.) and an azodicarbonamide blowing agent (Genitron EPA; Schering Polymer Additives) was injected by means of an injection-molding machine. A polyamide elastomer foam was prepared which had a skin layer having a surface on which the mirror surface was transferred. The resulting polyurethane foam was heat-treated to obtain a polyurethane foam material having an ASKER(C) hardness of 49°. The polyurethane foam was secondarily worked into an elastic blade as shown in FIG. 4. The elastic blade was set in a development device, and mounted on a laser beam printer. Streaks and irregularity in development were evaluated.

EXAMPLE 9

An ethylene-propylene foamed rubber sheet having been formed and worked and having an ASKER(C) hardness of 44° was bonded onto a stainless steel sheet of 60 μm thick. The foamed rubber was coated with a soluble nylon (Amylan M-8000, trade name, produced by Toray Industries, Inc.) dissolved in methyl alcohol. The laminated matter was processed secondarily to an elastic blade as shown in FIG. 3. The elastic blade was tested by using the aforementioned developing device containing a non-magnetic color toner and mounted on a laser beam printer, for streaks and irregularity in image development.

COMPARATIVE EXAMPLE 3

A polyurethane sheet having been formed and processed by a centrifugal molding machine and having a JIS-A hardness of 65° was bonded onto a stainless steel sheet of 60 μm thick. The polyurethane sheet was coated with a soluble nylon (Amylan, trade name, produced by Toray Industries, Inc.) dissolved in methyl alcohol. The laminated matter was processed secondarily into an elastic blade. The elastic blade was tested by using the aforementioned development device containing a non-magnetic color toner and mounted on a laser beam printer for streaks and irregularity in image development.

Table 2 shows the results of Examples 6 to 9 and Comparative Example 3. As shown in Table 2, the elastic blade in Examples 6 to 9 comprised of a pressure-controlling supporting layer, an elastic sponge layer, and electrifying layer resulted in uniform contact of the blade owing to the low elasticity of the sponge layer in comparison with Comparative Example 3.

TABLE 1

| | Example | | | | | Comparative Example | |
|---|---|---|---|---|---|---|---|
| | 1 | 2 | 3 | 4 | 5 | 1 | 2 |
| Polyamide component (%) | 10 | 30 | 50 | 70 | 90 | 0 | 100 |
| Triboelectrification (μC/g) | −15 | −18 | −20 | −23 | −25 | −10 | −30 |
| Toner coating state* on development sleeve | Fair | Good | Good | Good | Fair | Poor | Fair |
| Solid black density | 1.4 | 1.5 | 1.5 | 1.5 | 1.4 | 1.0 | 1.0 |

*Good: No image defect
Fair: A few streaks and a little irregularity in image
Poor: Remarkable streaks and irregularity

TABLE 2

| | Example 6 | Example 7 | Example 8 | Example 9 | Comparative Example 3 |
|---|---|---|---|---|---|
| Production Process* | A | A | A | B | B |
| Supporting layer | | | | | |
| Material | SUS | SUS | SUS | SUS | SUS |
| Thickness (μm) | 60 | 60 | 60 | 60 | 60 |
| Sponge layer | | | | | |
| Material | Foamed polyurethane rubber | Foamed polyurethane rubber | Foamed polyamide elastomer | Foamed ethylene-propylene rubber | Polyurethane rubber (not foamed) |
| Hardness JIS-A** | — | — | — | — | 65 |
| (ASKER(C)) | | | — | (44) | (>75) |
| Thickness (mm) | 2 | 2 | 2 | 2 | 2 |
| Electrifying layer | | | | | |
| Material | Polyurethane rubber | Polyurethane rubber | Polyamide elastomer | Nylon | Nylon |
| Thickness (μm) | 30 | 35 | 45 | 16 | 15 |
| Hardness of sponge plus electrifying layer | | | | | |
| JIS-A** | 15 | 38 | 35 | 35 | 72 |
| (ASKER(C)) | (27) | (50) | (49) | (49) | (≥75) |
| Streaks and irregularity in image*** | Good | Good | Good | Good | Fair |

*Production process A: Blowing in mold with integrated skin layer formed B: Bonding and coating
**JIS-A hardness: JIS K 6301
***Good: No image defect, Fair: some streaks and irregularity observed

What is claimed is:

1. An elastic blade for controlling an amount of feed of a developer, comprising a polyamide elastomer as an electrifying elastomer.

2. The elastic blade for controlling an amount of feed of a developer according to claim 1, wherein a content of a polyamide component in a polyamide elastomer structure ranges from 20 to 80%.

3. The elastic blade for controlling an amount of feed of a developer according to claim 2, wherein the polyamide elastomer is a block copolymer comprising polyamide and polyether.

4. The elastic blade for controlling an amount of feed of a developer according to claim 3, wherein the polyamide elastomer comprises a block copolymer in which polyamide and polyether are linked by ester linkage.

5. The elastic blade for controlling an amount of feed of a developer according to claim 4, wherein the polyamide is a carboxylated polyamide and the terminal amino groups of which are carboxylated.

6. The elastic blade for controlling an amount of feed of a developer according to claim 3, wherein the polyamide elastomer comprises a block copolymer in which polyamide and polyether are linked by amide linkage.

7. The elastic blade for controlling an amount of feed of a developer according to claim 6, wherein the polyamide is a carboxylated polyamide the terminal amino groups of which are carboxylated.

8. A development device, comprising a developer-holding vessel for holding a one-component type developer, a developer-holding member for delivering the developer from the vessel to a developing portion, and a developer feed-controlling member for controlling an amount of feed of the developer to be applied onto the developer-holding member, wherein the developer feed-controlling member to form a nip portion is an elastic blade comprising a polyamide elastomer as an electrifying elastomer.

9. The development device according to claim 8, wherein the polyamide elastomer comprises a block copolymer of polyamide and polyether.

10. A process cartridge comprising at least an electrophotographic photosensitive member and a development device which are integrated as one cartridge detachable from a main body of an image-forming apparatus, the development device comprising a developer-holding container for holding a one-component type developer, a developer-holding member for delivering the developer from the container to a developing portion, and a developer feed-controlling member for controlling an amount of feed of the developer to be applied onto the developer-holding member, wherein the developer feed-controlling member to form a nip portion is an elastic blade comprising a polyamide elastomer as an electrifying elastomer.

11. The process cartridge according to claim 10, wherein the polyamide elastomer is a block copolymer comprising polyamide and polyether.

12. An elastic blade for controlling an amount of feed of a developer, comprising pressure-controlling supporting layer for controlling pressure, an elastic sponge layer, and an electrifying layer.

13. The elastic blade for controlling the amount of feed of a developer according to claim 12, wherein the elastic sponge layer and the electrifying layer have a JIS-A hardness of not more than 50°.

14. The elastic blade for controlling the amount of feed of a developer according to claim 12, wherein the elastic sponge layer and the electrifying layer are formed by foam molding.

15. A development device comprising a developer-holding vessel for holding a one-component type developer, a developer-holding member for delivering the developer from the vessel to a developing portion, and developer feed-controlling member for controlling an amount of feed of the developer to be applied onto the developer-holding member, wherein the developer feed-controlling member to form a nip portion is an elastic blade comprising a pressure-controlling supporting layer, an elastic sponge layer, and an electrifying layer for controlling electrification.

16. A process cartridge comprising at least an electrophotographic photosensitive member and a development device which are integrated as one cartridge detachable from a main body of an image-forming apparatus, the development device comprising a developer-holding vessel for holding a one-component type developer, a developer-holding member for delivering the developer from the vessel to a developing portion, and a developer feed-controlling member for controlling the amount of feed of the developer to be applied onto the developer-holding member, wherein the developer feed-controlling member to form a nip portion is an elastic blade having a pressure-controlling supporting layer, an elastic sponge layer, and an electrifying layer for controlling electrification.

17. An elastic blade for controlling an amount of feed of a developer, which has on its surface an electrifying layer comprising a polyamide elastomer.

18. The elastic blade for controlling an amount of feed of a developer according to claim 17, wherein a content of the polyamide component in a polyamide elastomer structure ranges from 20% to 80%.

19. The elastic blade for controlling an amount of feed of a developer according to claim 18, wherein the polyamide elastomer is a block copolymer comprising polyamide and polyether.

* * * * *

UNITED STATES PATENT AND TRADEMARK OFFICE

CERTIFICATE OF CORRECTION

PATENT NO. : 5,895,150

DATED : April 20, 1999

INVENTOR(S) : MASAHIRO WATABE, ET AL.

It is certified that error appears in the above-identified patent and that said Letters Patent is hereby corrected as shown below:

COVER PAGE AT ITEM [22] FILED,
Insert: [*] Notice: This patent issued on a continued prosecution application filed under 37 CFR 1.53(d), and is subject to the twenty year patent term provisions of 35 U.S.C. 154(a)(2).

COLUMN 8,
Line 15, "from" should read --for--.

COLUMN 9,
Line 2, "nylon." should read --nylon--.

COLUMN 11,
Table 2, "formed B:" should read --formed ¶ B1--.

UNITED STATES PATENT AND TRADEMARK OFFICE

CERTIFICATE OF CORRECTION

PATENT NO. : 5,895,150

DATED : April 20, 1999

INVENTOR(S) : MASAHIRO WATABE, ET AL.

It is certified that error appears in the above-identified patent and that said Letters Patent is hereby corrected as shown below:

COLUMN 13,
Line 14, "comprising" should read --comprising a--.

Signed and Sealed this

Twentieth Day of June, 2000

*Attest:*

Q. TODD DICKINSON

*Attesting Officer*

*Director of Patents and Trademarks*